US007995940B2

(12) United States Patent
Hosier et al.

(10) Patent No.: US 7,995,940 B2
(45) Date of Patent: Aug. 9, 2011

(54) SYSTEM FOR MEASURING MARKING MATERIAL ON A SURFACE, SUCH AS IN COLOR XEROGRAPHY

(75) Inventors: Paul A Hosier, Rochester, NY (US); Shawn P Updegraff, Fairport, NY (US); Robert P Herloski, Webster, NY (US); R Enrique Viturro, Rochester, NY (US); Howard A Mizes, Pittsford, NY (US); Kenneth R Ossman, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 1029 days.

(21) Appl. No.: 11/838,383

(22) Filed: Aug. 14, 2007

(65) Prior Publication Data

US 2009/0047032 A1 Feb. 19, 2009

(51) Int. Cl.
*G03G 15/00* (2006.01)

(52) U.S. Cl. ..... 399/49

(58) Field of Classification Search ..... 399/49
See application file for complete search history.

(56) References Cited

U.S. PATENT DOCUMENTS

| | | | | |
|---|---|---|---|---|
| 4,967,238 | A * | 10/1990 | Bares et al. | |
| 5,694,223 | A * | 12/1997 | Katori et al. | 399/49 |
| 5,712,666 | A * | 1/1998 | Matsubara et al. | |
| 2006/0038873 | A1 | 2/2006 | Hirai et al. | |
| 2007/0003302 | A1 | 1/2007 | Mizes | |

* cited by examiner

*Primary Examiner* — David M Gray
*Assistant Examiner* — Laura K Roth
(74) *Attorney, Agent, or Firm* — Pillsbury Winthrop Shaw Pittman LLP

(57) ABSTRACT

A printing apparatus has a substantially shiny photoreceptor imaging surface, and a photosensor array disposed to receive specularly-reflected light from the imaging surface. A quantity of toner is placed on the imaging surface, and data is derived based on light reflected from the imaging surface. The reflected light is filtered to a color effectively complementary to the toner color. The system avoids noise caused by diffusely-reflected light from powdered toner.

14 Claims, 3 Drawing Sheets

SYSTEM FOR MEASURING MARKING MATERIAL ON A SURFACE, SUCH AS IN COLOR XEROGRAPHY

INCORPORATION BY REFERENCE

The following U.S. Published Patent Applications are hereby incorporated, each in its entirety, for the teachings therein: 2006/0209101 and 2007/0003302.

TECHNICAL FIELD

The present disclosure relates to systems for measuring marking material on a surface, as would be found, for instance, in measuring the density of toner particles on an electrostatographic or xerographic imaging member.

BACKGROUND

Electrostatographic or xerographic copiers, printers and digital imaging systems typically record an electrostatic latent image on an imaging member. The latent image corresponds to the informational areas contained within a document being reproduced. In one type of such a system, a uniform charge is placed on a photoconductive member and portions of the photoconductive member are discharged by a scanning laser or other light source to create the latent image. The latent image is then developed by bringing a developer, including colorants, such as, for example, toner particles, into contact with the latent image. The toner particles carry a charge and are attracted away from a toner supply and toward the latent image by an electrostatic field related to the latent image, thereby forming a toner image on the imaging member. The toner image is subsequently transferred to a physical media, such as a print sheet. The print sheet, having the toner image thereon, is then advanced to a fusing station for permanently affixing the toner image to the print sheet.

In multi-color electrophotographic printing, multiple latent images corresponding to each color separation are recorded on one or more photoconductive surfaces. The electrostatic latent image for each color separation is developed with toner of that color. Thereafter, each color separation is ultimately transferred to the print sheet in superimposed registration with the other toner images, creating, for example, a multi-layered toner image on the print sheet. This multi-layer toner image is permanently affixed to the print sheet to form a finished print.

In any printing apparatus, it is desirable to set up a feedback system by which the quality of output prints is monitored, and the behavior of the apparatus is monitored to counteract any detected print defects. U.S. Published Patent Application 2007/0003302 describes an extensive feedback system, wherein images (test images, or images such as those to be printed) are recorded in detail from the imaging surface of a photoreceptor, using input scanning hardware comparable in resolution and quality to that used for recording hard-copy images in a digital copier. A photosensor array is directed toward the photoreceptor to record the actual distribution of toner in response to the creation of test images. As mentioned in the Application, however, there are practical problems with reading toner-based test patterns, especially when trying to use specularly-reflected light in high toner density ranges, to increase the sensitivity of the measurements to spatial variation in toner density.

SUMMARY

According to one aspect, there is provided a method of operating a printing apparatus, the printing apparatus comprising a member defining a substantially shiny imaging surface, and a photosensor array disposed to receive light reflected from the imaging surface. A quantity of marking material of a first color is placed on the imaging surface. Data based on light reflected from the imaging surface is recorded. The reflected light is substantially entirely specularly reflected and filtered to a first filter color effectively complementary to the first color.

According to another aspect, there is provided a method of operating a printing apparatus, the printing apparatus comprising a member defining a substantially shiny imaging surface, and at least one photosensor array disposed to receive light reflected from the imaging surface. A plurality of patches of a first color is placed on the imaging surface, each patch having a predetermined target density, each patch extending across the image receptor. A plurality of patches of a second color is placed on the imaging surface, each patch having a predetermined target density, each patch extending across the image receptor. A first set of data based on light reflected from the imaging surface is recorded, the light being substantially entirely specularly reflected and filtered to a first filter color effectively complementary to the first color. A second set of data is recorded based on light reflected from the imaging surface, the light being substantially entirely specularly reflected and filtered to a second filter color effectively complementary to the second color. At least one of the first set of data and the second set of data is used to derive a gain function for at least one plurality of individual photosensors in at least one photosensor array.

DETAILED DESCRIPTION

Figure 1:
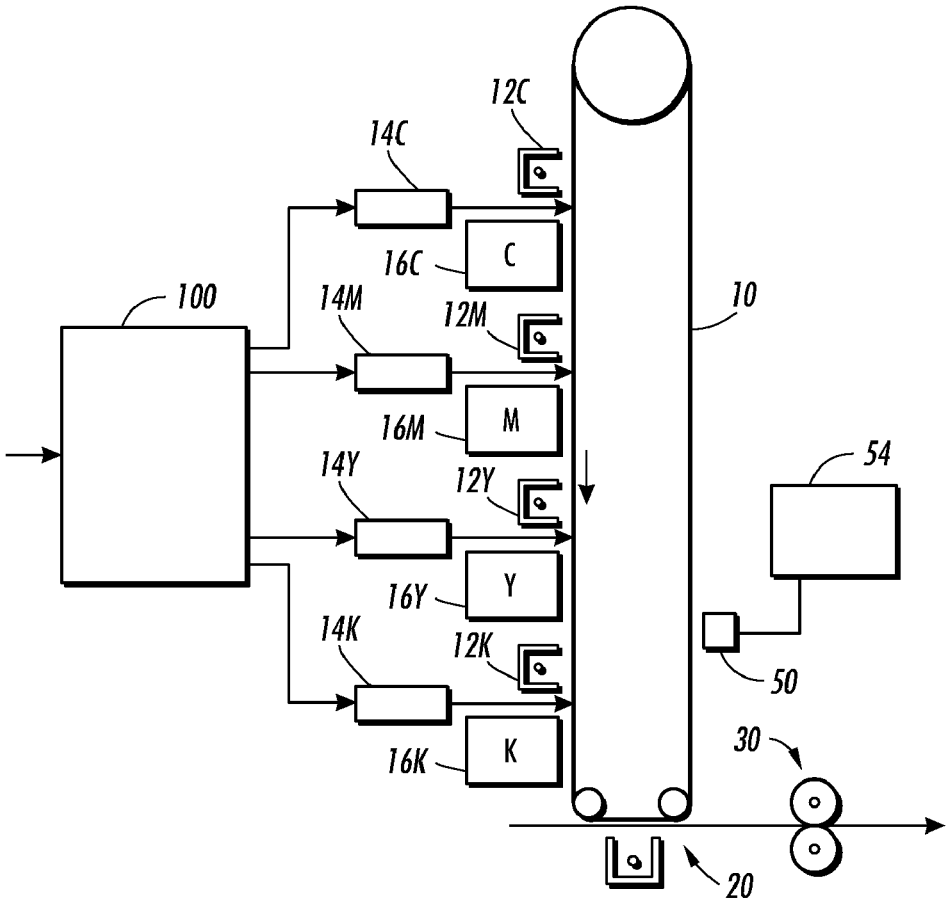
FIG. 1 PRIOR ART
FIG. 1 is a simplified elevational view of essential elements of one type of a color printer.

FIG. 1 is a simplified elevational view of essential elements of one type of a color printer, showing a context in which embodiments of the present disclosure may be utilized. Specifically, there is shown an "image-on-image" xerographic color printer, in which successive primary-color images are accumulated on a photoreceptor belt, and the accumulated superimposed images are in one step directly transferred to an output sheet as a full-color image.

The color printer of FIG. 1 includes an image receptor in the form of a belt photoreceptor 10, along which are disposed a series of stations, as is generally familiar in the art of xerography, one set for each primary color to be printed. For instance, to place a cyan color separation image on photoreceptor 10, there is used a charge corotron 12C, an imaging laser 14C, and a development unit 16C. For successive color separations, there is provided equivalent elements 12C, 14C, 16C (for cyan), 12M, 14M, 16M (for magenta), 12Y, 14Y, 16Y (for yellow), and 12K, 14K, 16K (for black). The successive color separations are built up in a superimposed manner on the surface of photoreceptor 10, and then the combined full-color image is transferred at transfer station 20 to an output sheet. The output sheet is then run through a fuser 30, as is familiar in xerography. In this embodiment, the photoreceptor 10 can be considered an "imaging surface," and the toners of any kind can be considered a "marking material," although these terms can be applied to any marking technology, such as ionography, liquid xerography, ink-jet, offset printing, etc.; and the imaging surface can be any kind of intermediate member or print sheet, depending on a given marking technology.

Also shown in FIG. 1 is what can be generally called a "monitor" 50, which can feed back to a control device 54. The monitor 50 can make measurements to images created on the photoreceptor 10. The information gathered therefrom is used by control device 54 in various ways to control in the operation of the printer, whether in a real-time feedback loop, an offline calibration process, a registration system, etc.

Figure 2:
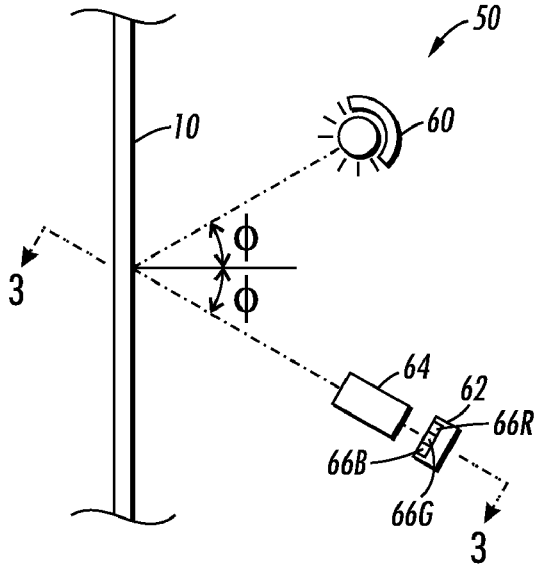
FIG. 2 PRIOR ART
FIG. 2 is a simplified elevational view of elements of a monitor for recording images on an imaging surface of photoreceptor.

FIG. 2 is a simplified elevational view of elements of a monitor 50 for recording images on an imaging surface of photoreceptor 10. Monitor 50 includes a light source 60 that transmits light to a predetermined area on the moving photoreceptor 10, and a photosensor array generally indicated as 62 that records light reflected from the photoreceptor 10. There may also be provided an imaging lens 64, such as a Selfoc® lens, in front of the photosensor array 62. As shown, the angle $\phi$ of illumination of light source 60 relative to the surface of photoreceptor 10 is equal to the angle $\phi$ of detection of photosensor array 62 relative to the surface of photoreceptor 10; in this way, photosensor array 62 receives substantially only specularly-reflected light reflected from the surface of photoreceptor 10.

As can be seen, in this embodiment there are provided three parallel linear arrays of photosensors (extending into the page in the view of FIG. 2), marked 66R, 66G, and 66B. Each array has a filter associated therewith, to accept a "filter color" of red, green, and blue light respectively. (In an alternative embodiment, still under the rubric of "filtered light" or a "filter color," there can be provided a single linear array of photosensors, and multiple, selectable light sources such as LEDs, each source emitting a particular color of light, such as red, green and blue.) The size of each photosensor in each array is comparable to the size of a pixel that could be placed on the photoreceptor (or other imaging member) by the printing apparatus, so that any detected image defect associated with one photosensor can be "matched" with a pixel created by the printing apparatus, thereby allowing correction of, for example, an individual, identified LED in an LED bar, or an ejector in an ink-jet printing system.

Many common designs of photoreceptor 10 can be characterized as "shiny." As used herein, the term "shiny" shall mean that there is relatively little light diffusely reflected from the surface; when the light source and photosensor array are positioned as shown in FIG. 2, it can reasonably be said that the detected light is almost entirely specularly reflected. When any quantity of toner is placed on the photoreceptor surface, however, not only is the color of the surface effectively changed, but the characteristic of reflected light as well: whereas the bare photoreceptor is shiny, the optical roughness of the unfused toner layer makes the surface to varying extents diffuse. The diffuse quality of the toner layer will cause diffusely-reflected light from the toner layer to mix in with the specularly-reflected light from the shiny surface being detected by photosensor array 62.

The admixture of unpredictable amounts of diffusely-reflected light into an overall "specular" system is a source of error that can affect the performance of an entire image quality control system. The diffusely-reflected light reflected from a given point on the photoreceptor 10 will be directed not only to the individual photosensor directly corresponding to the point, but possibly also to adjacent photosensors along the array at various distances from the point.

Figure 3:
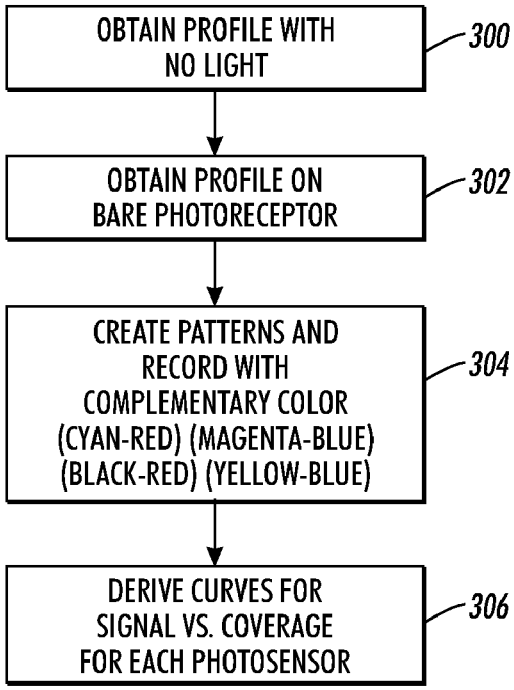
FIG. 3 is a flowchart showing a calibration method used with the apparatus of FIGS. 1 and 2.

FIG. 3 is a flowchart showing a calibration method used with the apparatus as described above, as would occur at periodic or as-needed calibration operations for the whole system. The illustrated steps, in one embodiment, are applied individually to each photosensor in an array, such as to determine the offset and gain associated with that particular photosensor; any signal corrections performed on subsequent signals from the photosensor are typically applied to that photosensor only.

At step 300 a "profile" (readings from each individual photosensor across an array) is obtained with light off, to determine the offset for each individual photosensor of a given color. For all captures in this embodiment, many scan lines are captured and the results averaged to get rid of thermal noise. In an embodiment having multiple linear arrays of photosensors, this light-off profile is obtained for each array separately.

At step 302 a profile is obtained of the bare photoreceptor belt with the light on. This profile is used with above dark capture to determine the gain of each photosensor, including any effect of across the belt reflectance variation (typically very little), lamp variation, and responsivity variation. All subsequent captures are then corrected for pixel by pixel offset and gain. As with the offset profile described above, in an embodiment having multiple linear arrays of photosensors, the gain-correction profile is obtained for each array separately.

At step 304 a series of cyan halftone patches are developed on the photoreceptor and then are recorded, using only the channel corresponding to the complementary-color array, in this case the red array 66R. The signal corresponding to each patch is proportional to the amount of photoreceptor surface that is not covered by toner, e.g., a 10% coverage patch will have about 90% of full signal. There will be small amount of diffusely-reflected light that is directly proportional to the amount of coverage, but the use of complementary light tends to minimize this source of noise.

Figure 4:
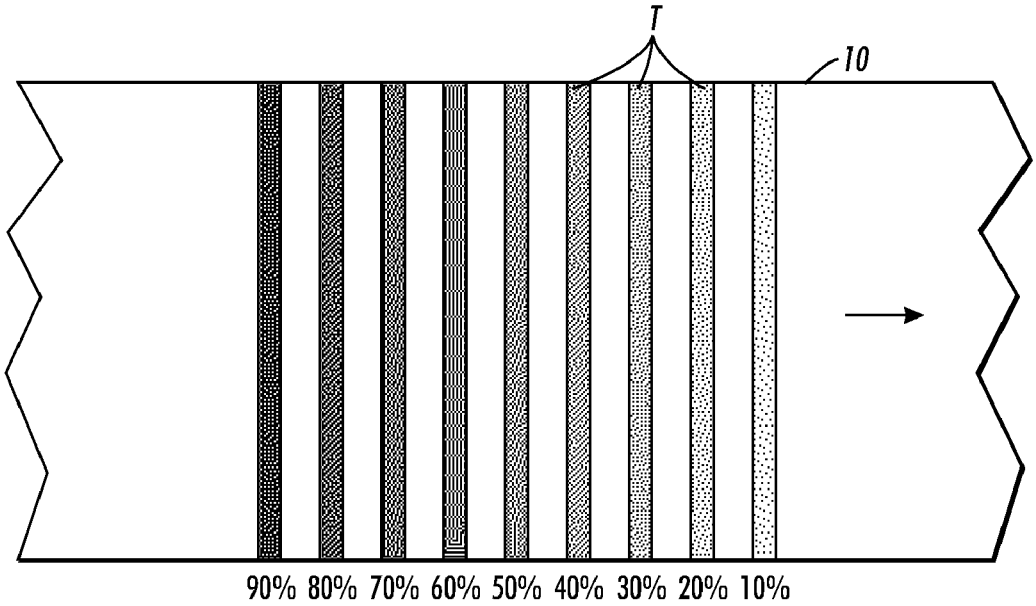
FIG. 4 is a plan view showing a series of halftone patterns extending across an image receptor.

FIG. 4 is a plan view showing a series of halftone patches, each indicated as T, and corresponding to each of a set of target halftone values, extending across the photoreceptor 10, as would apply to each single color in the tests described at step 404. In the illustrated embodiment, for each color there is made eight patches T, of target densities of 10%, 20%, etc., each extending across the photoreceptor 10, and thus corresponding to an entire length of each photosensor array such as 66G.

Returning to FIG. 3, this process of creating patterns and recording with an at least substantially complementary color, as at step 304, is repeated for other colors; in one embodiment, magenta and yellow sets of patterns are created on the photoreceptor 10, each of which are measured through the blue photosensors. Also in such an embodiment, a black set of patterns is measured through the red photosensors. In alternative embodiments, blue-filtered photosensors measure yellow patterns, red-filtered photosensors measure cyan patterns, and any set of photosensors (including unfiltered "white" photosensors, if available) can be used to measure black patterns.

At step 306 a curve of signal versus toner coverage is determined for each photosensor in the array. Broadly speaking, the curve can be used to influence algorithms relating to the tone response curve (TRC), or the relationship between amount of toner placed versus darkness of the imaging surface or resultant print for a particular color, as manifest in the larger control system of the printer. A different curve is obtained for each of a plurality of photosensors, or all of the photosensors, in a given array, to facilitate the location, isolation, and correction of "bad" pixels that are causing streaks in the output prints.

In the present embodiment, the photosensors 66R, 66B, 66G are used in specular mode to detect how much of the photoreceptor 10 is bare, while minimizing the influence of any diffusely-reflected light, particularly if the specular reflected light and diffuse reflected light do not have similar profiles along a given photosensor array. The use of the complementary color photosensors in measuring the primary-color patterns allows only one color light through to each photosensor, and since each photosensor is filtered to the complement of the light reflected from the toner, any diffusely-reflected light is almost entirely excluded from detection. With reference to FIG. 3, use of the imaging lens (such as a Selfoc® lens) 64 causes light, whether specular or diffuse, from one small area on the photoreceptor 10 to reach one photosensor, with no mixing from adjacent small areas. The error caused by diffuse light from a toner layer on photoreceptor 10 relates to the assumption that diffuse light is zero using a specular-only calibration method. In contrast, if only white light were used for calibration, it would be impossible to distinguish toner coverage variation from the diffuse/specular nonuniformity variation.

Figure 5:
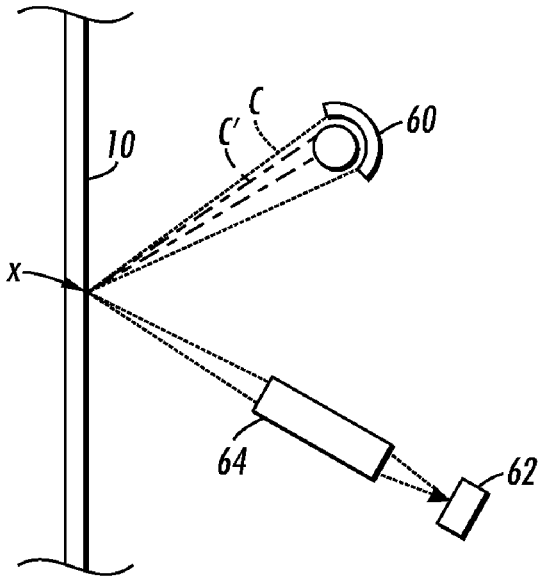
FIG. 5 is a simplified elevational view of elements of a monitor for recording images on an imaging surface of photoreceptor, showing a source of one type of calibration error.

Other, subtler, errors in response caused by calibration are obviated by the system of the present disclosure. FIG. 5 is a diagram illustrating the behavior of light in the system shown in FIG. 2, explaining another source of calibration error which can be obviated by the above-described method. As is known, an imaging lens 64 such as a Selfoc® lens includes an arrangement of small lenslets. When light is specularly reflected from a point X on photoreceptor 10, the original light from lamp 60 directed to the point X can be considered a cone C, having a thick end as the relatively large size of the lamp 60 narrowing to a point at X. In a perfect case, using white light, the light reflected from X is transmitted through imaging lens 64 with minimal loss. If, however, there is some tilt of one or more lenslets within imaging lens 64 relative to the "perfectly straight" path of light from point X through lens 64 to sensor array 62, the effect will be that only a portion C' of the full cone C of specularly-reflected light from lamp 60 to point X will be collected at some of the photosensors at the photosensor array 62. This diminution of specularly-reflected light in cone C' relative to the perfect cone C will not, however, be as pronounced for diffuse light: the long-term effect of less specular light than truly is present will be a distortion of the true proportions of specular to diffuse light at various levels of toner coverage (as represented by the various patches in FIG. 4).

The approach of the present disclosure, wherein specular light is measured using complementary-filtered light, obviates the lenslet-tilt source of error. As part of step 306 of FIG. 3, profiles captured by the photosensor of 100% coverage patches will be normalized to the profile captured by the photosensor 62 of the bare photoreceptor 10. Because of the differences in behavior of the diffuse light scattered by the coverage patch and the specularly-reflected light from the photoreceptor, the normalization process will induce the lenslet errors of the specularly-reflected light into the normalized profile of the 100% coverage patch. However, since the light diffusely reflected by the 100% coverage patch is complementary to the filter color of the photosensor, the total amount of light captured by the photosensor will be small, relative to the total captured light specularly reflected off the bare photoreceptor belt, and thus the error induced by the normalization process will be a very small fraction of the total signal range.

Figure 6:
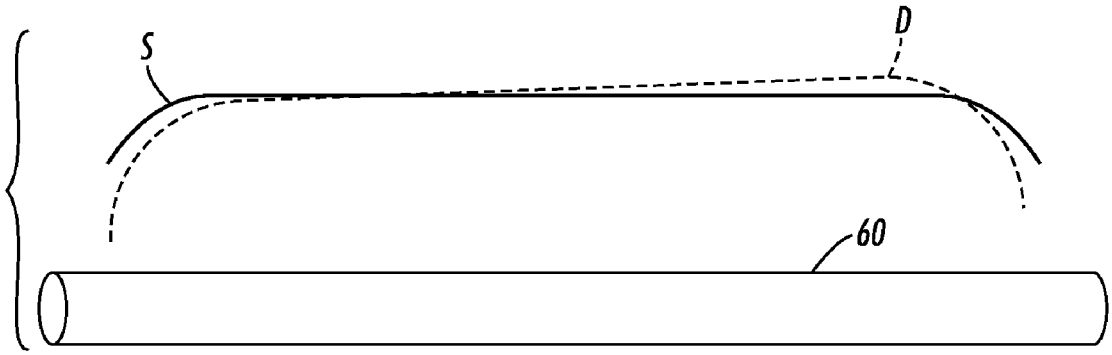
FIG. 6 shows a lamp in isolation, along with typical profiles associated with different portions of the length of the lamp.

Another source of error obviated by the present system relates to the fact that a typical lamp such as 60 has varying optical properties along its length. FIG. 6 shows typical profiles associated with a single lamp 60 (along a direction going into the page in the view of FIG. 2). For various reasons, the quality of light at different portions of, for example, a fluorescent lamp will result in different reflectivities of a specular versus a diffuse surface, as shown by the different shapes of the curves S and D associated with lamp 60. The approach of the present disclosure, wherein specular light is measured using complementary-filtered light, obviates this lamp-profile source of error.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating a printing apparatus, the printing apparatus comprising a member defining a substantially shiny imaging surface, and a linear photosensor array disposed to receive light reflected from the imaging surface, the method comprising:

placing a quantity of marking material of a first color on the imaging surface; and recording, using the linear photosensor array, data based on light reflected from the imaging surface, the light being substantially entirely specularly reflected and filtered to a first filter color effectively complementary to the first color so as to reduce noise caused by diffusely-reflected light.

2. The method of claim 1, the marking material comprising toner.

3. The method of claim 1, the member defining the imaging surface is a photoreceptor of the printing apparatus.

4. The method of claim 1, further comprising applying the data to a Toner Response Curve (TRC) algorithm.

5. The method of claim 1, the data being associated with each of a plurality of individual photosensors in the array.

6. The method of claim 1, the placing including placing a plurality of patches on the imaging surface, each patch having a predetermined target density.

7. The method of claim 6, each patch extending across the image receptor.

8. The method of claim 6, the recording including recording data based on light reflected from the imaging surface from each of the plurality of patches, and further comprising applying the recorded data to derive a gain function for each of a plurality of individual photosensors in the array.

9. The method of claim 8, the placing including placing a quantity of marking material of a second color on the imaging surface.

10. The method of claim 9, the recording including recording data based on light reflected from the imaging surface and filtered to a second filter color effectively complementary to the second color so as to reduce noise caused by diffusely-reflected light.

11. A method of operating a printing apparatus, the printing apparatus comprising a member defining a substantially shiny imaging surface, and at least one linear photosensor array disposed to receive light reflected from the imaging surface, the method comprising:

placing a plurality of patches of a first color on the imaging surface, each patch having a predetermined target density, each patch extending across the image receptor;

placing a plurality of patches of a second color on the imaging surface, each patch having a predetermined target density, each patch extending across the image receptor;

recording, using the linear photosensor array, a first set of data based on light reflected from the imaging surface, the light being substantially entirely specularly reflected and filtered to a first filter color effectively complementary to the first color so as to reduce noise caused by diffusely-reflected light;

recording, using the linear photosensor array, a second set of data based on light reflected from the imaging surface, the light being substantially entirely specularly reflected and filtered to a second filter color effectively complementary to the second color so as to reduce noise caused by diffusely-reflected light; and applying at least one of the first set of data and the second set of data to derive a gain function for at least one plurality of individual photosensors in at least one photosensor array.

12. The method of claim 11, the marking material comprising toner.

13. The method of claim 11, the member defining the imaging surface is a photoreceptor of the printing apparatus.

14. The method of claim 11, further comprising applying the first set of data and the second set of data to a Toner Response Curve (TRC) algorithm.

* * * * *